US005254806A

United States Patent [19]

Gross et al.

[11] Patent Number: 5,254,806

[45] Date of Patent: Oct. 19, 1993

[54] INSULATED MAGNET WIRE, METHOD OF FORMING THE SAME, AND TRANSFORMER WINDINGS FORMED THEREFROM

[75] Inventors: Steven Gross, Fort Wayne, Ind.; John Hessler, Payne, Ohio

[73] Assignee: General Electric Co., New York, N.Y.

[21] Appl. No.: 801,003

[22] Filed: Dec. 2, 1991

[51] Int. Cl.[5] ..... H01B 5/02; H01B 7/00

[52] U.S. Cl. ..... 174/133 R; 156/54; 156/201; 156/202; 174/110 R; 174/119 R; 174/124 R; 174/124 G

[58] Field of Search ..... 174/133 R, 124 R, 124 G, 174/110 R, 119 R, 117 A; 156/53, 54, 201, 202

[56] References Cited

U.S. PATENT DOCUMENTS

| | | | |
|---|---|---|---|
| 1,455,744 | 5/1923 | Diamond | 174/117 A |
| 2,925,174 | 2/1960 | Stow | 156/53 |
| 3,501,728 | 3/1970 | Barriball | 336/155 |
| 3,558,803 | 1/1971 | Osborn et al. | 174/119 R |
| 3,577,309 | 5/1971 | Pendleton et al. | 428/390 |
| 3,600,802 | 8/1971 | Jorgensen et al. | 29/624 |
| 4,159,920 | 7/1979 | Anderson et al. | 156/54 |
| 4,270,963 | 6/1981 | Howat | 156/201 |
| 4,595,793 | 6/1986 | Arroyo et al. | 174/121 A |
| 5,049,215 | 9/1991 | Strauss | 174/119 R X |

FOREIGN PATENT DOCUMENTS 1233862 6/1971 United Kingdom .

*Primary Examiner*—Morris H. Nimmo
*Attorney, Agent, or Firm*—Richard A. Menelly

[57] ABSTRACT

A magnet wire of modified cross-section is electrically insulated by adhering thereto an insulation tape which does not require a high temperature adherance step. The insulation tape has a pressure-sensitive adhesive coating which, prior to application to the magnet wire, is covered by a release strip. Just prior to application of the insulation tape to the magnet wire, the release strip is removed from the tape to uncover the adhesive coating and allow pressure-sensitive bonding of the insulation tape to the magnet wire.

13 Claims, 2 Drawing Sheets

FIG.1
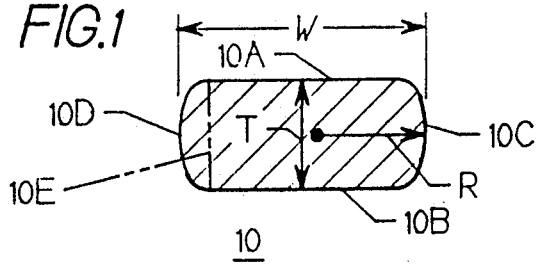
FIG.2
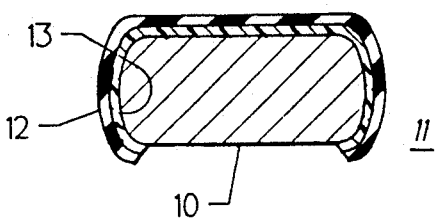
FIG.3a
FIG.3c
FIG.3b
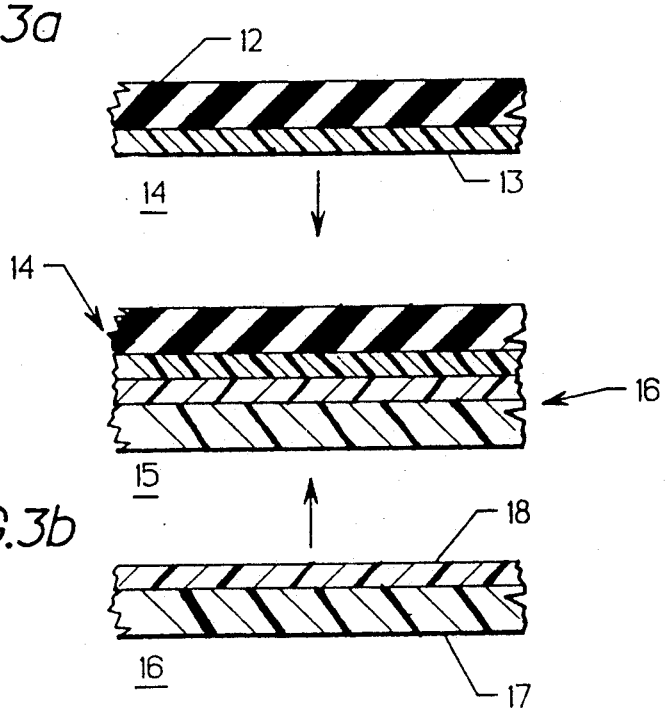

INSULATED MAGNET WIRE, METHOD OF FORMING THE SAME, AND TRANSFORMER WINDINGS FORMED THEREFROM

FIELD OF THE INVENTION

This invention relates to an improved insulated magnet wire, to a method of forming the same, and also to a coil formed therefrom.

DESCRIPTION OF RELATED ART

In commercial magnet wire applications, an electrical insulation material, in tape form is commonly employed as electrical insulation for the magnet wire. The insulating tape is coated with a heat-cured adhesive substance which substance is cured by heating after application of the tape to a wire, which wire is essentially square or rectangular in cross section. U.S. Pat. No. 4,159,920 to G. Andersson et al, granted Jul. 3, 1979, describes a typical prior art method for insulating a magnet wire with a wrapped insulation tape which is precoated with an epoxy adhesive resin. The epoxy must be thermally cured after application thereof to the magnet wire to insure adhesion between the tape and the wire. British Patent Specification 1,233,862 published Jun. 3, 1971 discloses a similar procedure for coating and forming magnet wire.

One problem with the aforesaid magnet wire manufacturing procedure is the required heat curing of the adhesive to drive off volatile solvents that are employed when a binder material is used co-extensive with the adhesive. It would be economically advantageous to apply an adhesive coated electrical insulation tape to a magnet wire without incurring the extra process cost and time involved in heating and reheating the coated magnet wire to cure the adhesive.

Other problems that occur with magnet wire manufactured in accordance with the aforesaid prior art include the use of rigid (or stiff) insulating tapes which result in splitting or cracking of such tapes as the magnet wire is wound around a square or rectangular mandrel to form an electrical winding.

The splitting and cracking of the insulation tape is caused partly by the use of rigid insulation tape materials that do not stretch or flex to conform to the shape of the magnet wire when the latter is wound around the mandrel. Heating the insulation tape to cure the adhesive makes the insulation tape even more brittle and more susceptible to splitting or cracking.

An additional contributor to rupture of insulation on a coiled magnet wire is the cross-sectional shape of the wire after it has been formed into a coil. When an insulated magnet wire of essentially square or rectangular shape, as described in the prior art, is wound around a mandrel to form a coil winding, plastic deformation of the wire results as the wire is taken through the ninety degree bends of the coil. The tensile forces on the side of the wire opposite the mandrel cause the width of that side of the wire to contract, while the compressive forces on the side of the wire facing the mandrel cause the width of that side of the wire to expand whereupon the resulting magnet wire cross section assumes a trapezoidal configuration. The resultant trapezoidal configuration of the wire increases the overall width of the magnet wire, so as to significantly increase the amount of space taken up by the wire in each adjacent turn in the coil. The trapezoidal cross-section of the wound magnet wire also creates sharp edges on the wire at the corners of the windings which can result in rupture of the insulation tape thereby causing electrical arcing between adjacent winding turns.

Additionally, current prior art processes for applying the insulation tape are relatively slow and must be accomplished as separate, off-line operations since process speed is dependent on the time required to heat and reheat the wire.

SUMMARY OF THE INVENTION

This invention relates to a magnet wire which has a cross-sectional configuration that reduces abrasion of the insulation tape, and also occupies minimal space during the electrical magnet wire winding operation in that the cross sectional configuration of the wire of this invention produces a dimensionally stable wire that will not substantially deform when wound into a coil.

The insulation tape is a fibrous soft, flexible material which has one side thereof coated with a pressure-sensitive adhesive to provide pressure sensitive bonding properties to the insulation tape without the need to heat-cure the wrapped wire. The adhesive is covered with a coated release strip that is stiffer or more rigid than the insulation tape to prevent stretching of the insulation tape prior to application thereof to the wire. The release strip also prevents the adhesive from being exposed to contaminants prior to application thereof to the wire. The coated release strip is removed from the insulation tape to uncover the adhesive immediately prior to application of the insulation tape to the magnet wire surface.

It is therefore an object of this invention to provide an insulated magnet wire that does not require heat to cure the insulation materials or to drive off organic solvents from the adhesives used for bonding the insulation materials to the magnet wire.

It is another object of this invention to provide an insulation tape and an application process that permits the use of insulation tape materials which allow the insulated magnet wire to be wound around square or rectangular mandrels without cracking or splitting the corners of the insulation tape.

It is a further object of the invention is to provide a new conductor wire shape having a modified rectangular cross-section that minimizes the space required for each turn when the insulated magnet wire is formed, while decreasing damage to the insulation tape.

It is an additional object of this invention to provide a high speed method of applying insulation tape to magnet wire.

These and other objects and advantages of the invention will become more readily apparent to one skilled in the art from the following detailed description of the invention when taken in conjunction with the accompanying drawings, in which

BRIEF DESCRIPTION OF THE DRAWING

FIG. 1 is a cross-sectional view of a preferred embodiment of a magnet wire formed in accordance with this invention;

FIG. 2 is a view of the magnet wire of FIG. 1 after application of the insulation tape to the wire;

FIG. 3A is an enlarged sectional view of the insulation tape of FIG. 2;

FIG. 3B is an enlarged sectional view of a release strip;

FIG. 3C is an enlarged sectional view of the release strip of FIG. 3B applied to the insulation tape of FIG. 3A;

FIG. 5 is view similar to FIG. 1 but showing another embodiment of a conductor wire.

DESCRIPTION OF THE PREFERRED EMBODIMENT

Figure 4:
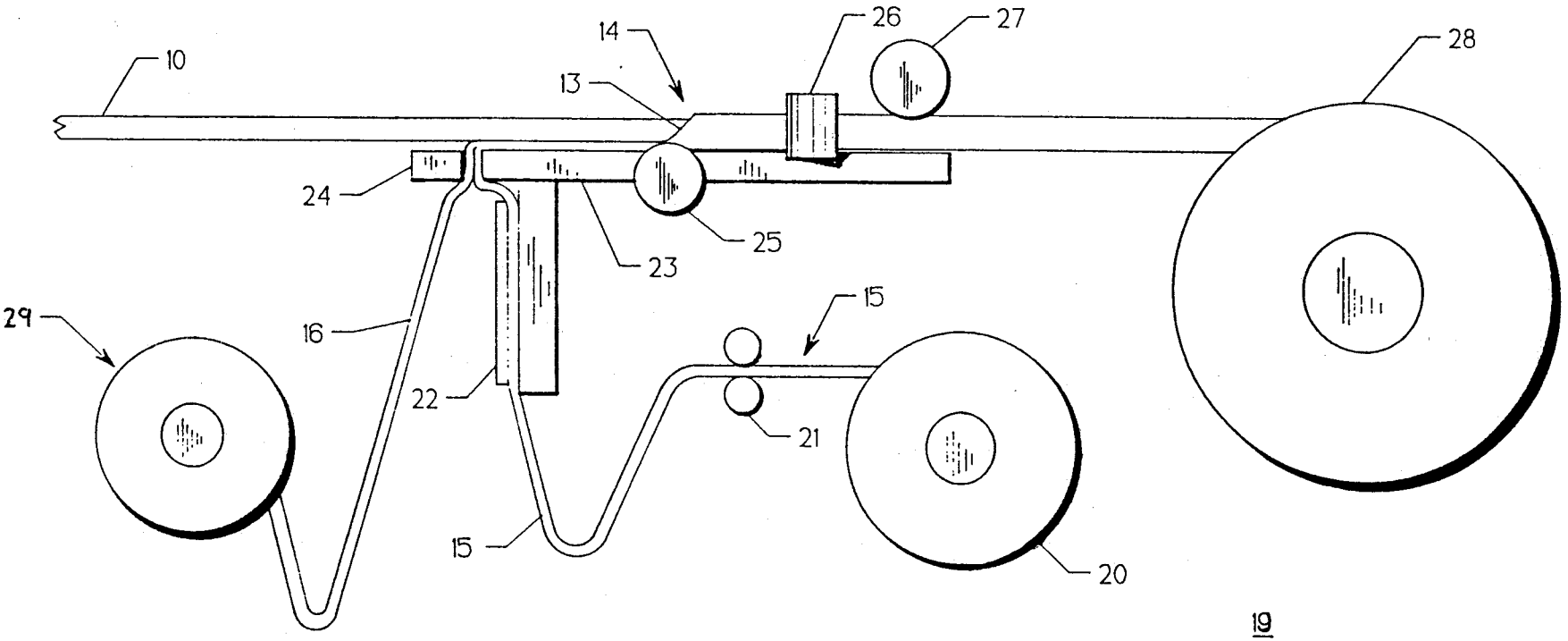
FIG. 4 is a schematic representation of the equipment used for separating the release strip from the insulation tape, and applying the separated insulation tape to the magnet wire of FIG. 1.

FIG. 1 depicts the modified rectangular cross-sectional shape of a magnet wire conductor 10 prior to application of a layer of insulation tape where the radius of curvature R of the opposing ends 10C and 10D of the conductor 10 equals, or is greater than the wire thickness T defined between the opposing sides 10A and 10B of the conductor 10. It has been determined that this optimum side geometry, which is proportional to the thickness of the wire, beneficially reduces abrasion to the insulation tape when the latter is applied to the magnet wire and subjected to subsequent coil winding operations, as will be described in greater detail hereinafter. The optimum geometry also reduces the space that each turn of the magnetic wire requires within an electrical magnet wire winding. The magnet wire geometry depicted in FIG. 1 does not cause expansion of the width of the magnet wire during the winding operation because when the side radius R is equal to or larger than the wire thickness T the conductor wire 10 cannot be deformed to the trapezoidal configuration during the coil winding process. The formation of sharp edges on the covered wire is thus prevented. Since the conductor wire 10 will not physically deform during the coil winding operation, it will not, when wound, laterally expand at the corners of the winding. This allows the use of thicker insulation tapes. For example, a rectangular wire having a width dimension of 0.300 inch which is used to form a coil that can expand to a dimension of 0.312 inch wide when bent 90 degrees around a winding mandrel. When the modified wire of this invention is used, the width dimension of the wire will not expand when the insulated wire is wound into a coil, thus allowing the use of bulkier insulation in the same coil space. If the side radius of the wire is substantially less than the thickness of the wire, then the mass of the coil will be insufficient for optimum coil performance.

Further conductor efficiency can be gained by forming the radius of curvature R only on the bottom half of the magnet wire that is closest to the mandrel as the magnet wire is being wound. The remainder of the sides, as indicated in 5E in FIG. 5 can be rectilinear. This results in a desirable increase in the overall cross sectional area of the magnet wire with no loss of space, and only a slight decrease in resistance to abrasion between adjacent windings, because the radiused side of the wire is the inner, normally expanded side when the wire is formed into a coil whereby formation of the trapezoidal cross section is avoided.

It is noted that the improved abrasion resistance imparted to the magnet wire having the cross-section depicted in FIG. 1 allows the use of softer, more flexible insulation tapes that stretch in all directions to allow the insulation tape to elongate and conform to any changes in the magnet wire configuration that occur during the magnet wire winding operation.

The fibrous highly stretchable insulation tape allows greater flexibility to the wrapped wire. The insulated magnet wire of the prior art must pass a flexibility qualification standard which requires that the wrapped wire must be wrappable on an arbor with a 4:1 diameter proportion relative to the major cross-sectional dimension of the wrapped wire, without exhibiting any insulation cracking or splitting. The insulated magnet wire of this invention can be wrapped on an arbor with a 1:1 arbor/wire diameter ratio without cracking or splitting the insulation tape. This quality is a highly desirable result of the invention, which cannot be met by the prior art heat-cured insulated magnet wire. Since the insulation tape of this invention does not require heat to bond it to the wire, it will retain its initial soft and flexible properties.

The magnet wire conductor 10 (hereafter "conductor") is formed into an insulated covered magnet wire 11 by the application of a continuous web of electrical insulating material 12 which includes a coating of pressure-sensitive adhesive 13 as illustrated in FIG. 2. In some applications, the insulation covering may be omitted across the top and one end of the conductor, in order to conserve insulation. The electrical insulating material is a soft, flexible fibrous material, and can be formed, for example, of glass fibers aramid fibers, polymer fibers, and combinations thereof. Fibrous aramid materials that are manufactured utilizing spunlacing or hydraulic fiber entanglement techniques are especially beneficial since they normally possess multi-directional elongation properties.

An insulating tape composite 15 consisting of an insulation tape component 14 and release strip component 16 can best be seen by referring now to FIG. 3C. The insulation tape component 14 is prepared by coating the insulation material 12 with the pressure sensitive adhesive 13, as depicted in FIG. 3A. The release strip component 16 is prepared by coating a release paper material 17 with a release agent 18. Immediately after the application of the adhesive 13 to the insulation material 12 to form the insulation tape component 14 the release strip component 16 is affixed to the insulation tape component 14 by covering the adhesive 13 with the release agent 18. The resulting insulating tape composite 15 can be rolled into a continuous reel for easy shipment and handling and can be later applied to the wire conductor 10 as best seen by referring to FIG. 4.

The wire coating assembly 19 is arranged next to a continuous source of the conductor 10 as it is being formed or extruded, or can be arranged independently as an off-line operation, if desired.

The insulating tape composite 15 described earlier is drawn from a supply reel 20 by a pair of driven rollers 21. The driven rollers are synchronized with the speed of the continuous source of the conductor 10 as it is drawn through the wire covering assembly so that slack as indicated at 15' is created thereby eliminating any tension on the insulating tape composite 15 between the drive rollers 21 and the point of application to the conductor, so as to prevent any premature stretching of the insulating tape composite 15. The insulating tape composite 15 is guided to the conductor 10 by passing through the guide block 22. Immediately prior to making contact with the conductor at the leading edge of base plate 23, the release strip component 16 is separated from the insulating tape component by means of a stripper block 24 and taken up by red 29. The adhesive 13 is thus exposed so that pressure sensitive bonding of the insulation tape component 14 to wire side 10A is accomplished, while folding the remaining unbonded portions of the insulation tape component 14 to facilitate bonding thereof to the ends 10C and 10D of the conductor 10. A set of opposing elastomeric rollers indicated generally by the numeral 25 apply pressure to the ends 10C, 10D and deform to press and bond the insulation tape component 14 to the conductor ends 10C and 10D, while folding the remainder of the insulation tape component 14 around each conductor end 10C and 10D in position to faciltate bonding to conductor side 10A or 10B. The final bonding step is completed as roller 27 applies pressure to side 10A or 10B to complete the insulation covered magnet wire 11 as illustrated in FIG. 2. The completed insulated magnet wire is then collected on a reel 28 as shown for later use, or as mentioned previously can be fed directly into a coil winding station.

Still referring to FIG. 4 it is noted that when the insulating tape composite 15 is drawn from the supply reel 20 by the driven rollers 21, the release strip component 16, due to the stiffness properties of the paper material, functions to prevent any premature stretching of the insulation tape component 14, thus preserving the elongation properties of the insulation tape 14. The release strip component 16 functions to also protect the adhesive from contaminants until the moment that the adhesive-coated insulation tape 14 is applied to the conductor.

An insulated covered magnet wire is produced for use in transformers, motors, and the like according to this invention by using a stretchable insulation covering, which is applied to a magnet wire of modified rectangular cross-section. By using a pressure-sensitive adhesive, without the use of supplemental solvents or the application of heat, the invention results in a cost-effective environmentally favorable magnet wire-forming process.

The fibrous, flexible, soft insulating tape, and its insulation tape/release strip composite is the invention of Martin Weinberg, and is disclosed and claimed in a copending U.S. patent application Ser. No. 07/801,745 filed Dec. 3, 1991, entitled Magnet Wire Insulation. The pressure sensitive adhesive which is preferred for use with the spunlaced aramid insulation is a thermosetting polymethymethacrylate crosslinkable pressure sensitive adhesive of high molecular weight which is saturated and resistant to oxidation. The preferred release agent coated onto the paper release strip is polydimethylsiloxane which is thermoset with a crosslinker and catalyst, and which forms a surface on the paper release strip which resists penetration by the acrylic adhesive which it covers. The release strip thus peels readily away of the adhesive coated surface of the insulation when the insulation is laid onto the conductor wire.

It will be appreciated that this invention involves the use of a wire with a modified cross section, which allows the application of a soft, flexible insulation tape to the wire. No lateral expansion of the wire will occur when the covered wire is formed into a coil. The result is a faster insulating process and a more flexible insulated wire.

Since many modifications and variations of the above described embodiment of the invention will be readily apparent to those skilled in the art, it is not intended to limit the invention otherwise than as required by the appended claims.

What is claimed is:

1. An insulated magnet wire comprising a conductor wire covered by an electrical insulation material, wherein said conductor wire has a cross-section defined by a pair of planar opposing sides and a pair of at least partially radiused curvilinear opposing ends, said sides being separated by a distance which is equal to or less than the radius of curvature of said curvilinear ends.

2. The magnet wire of claim 1 wherein said electrical insulation material is a soft, flexible fibrous insulation tape which at least partly covers said wire.

3. The magnet wire of claim 2 wherein said tape is bonded to said conductor wire by means of a pressure sensitive adhesive which does not require heat curing to bond to the wire.

4. An insulated magnet wire comprising a conductor wire covered by an electrical insulation material, wherein said conductor wire has a cross-section defined by a pair of planar opposing sides and a pair of at least partially radiused curvilinear opposing ends, said sides being separated by a distance which is equal to or less than the radius of curvature of said curvilinear ends, said electrical insulation material consisting of a soft flexible fibrous insulation tape which at least partly covers said wire, said tape being bonded to said conductor wire by means of a pressure sensitive adhesive which does not require heat curing to bond to the wire and comprising a spunlaced aramid material.

5. The magnet wire of claim 4 wherein said adhesive is an acrylic adhesive.

6. The magnet wire of claim 5 wherein said adhesive is a crosslinkable polymethylmethacrylate.

7. An insulated magnet wire comprising a conductor wire covered by an electrical insulation material, wherein said conductor wire has a cross-section defined by a pair of planar opposing sides and a pair of at least partially radiused curvilinear opposing ends, said sides being separated by a distance which is equal to or less than the radius of curvature of said curvilinear ends, said electrical insulation material consisting of a soft, flexible fibrous insulation tape which at least partly covers said wire whereby said tape covers both of said curvilinear ends and one of said planar sides of said conductor wire, the other of said planar sides of said conductor wire being substantially uncovered.

8. An insulated magnet wire comprising a conductor wire, and an insulation material at least partially covering said wire, said insulation material being a spunlaced aramid bonded to said wire by a pressure-sensitive adhesive.

9. An insulated magnet wire of claim 8 wherein said conductor wire has a cross-section defined by a pair of planar opposing sides and a pair of radiused curvilinear opposing ends, said sides being separated by a distance which is equal to or less than the radius of curvature of said curvilinear ends.

10. The magnet wire of claim 8 wherein said pressure-sensitive adhesive is a crosslinkable polymethylmethacrylate.

11. A method of forming an electrically insulated magnet wire, said method comprising the steps of:

providing a supply of conductor wire;

providing a supply of electrical insulation, said insulation comprising a soft, flexible fibrous insulation tape having a pressure-sensitive adhesive coating thereon, and a release strip peelably bonded to said insulation tape and covering said adhesive coating;

continuously feeding said conductor wire along a path;

continuously feeding said insulation along a path which converges with the wire path to a point of contact of said insulation with said wire;

peeling said release strip from said insulation tape immediately prior to contacting said insulation tape with said wire to uncover said adhesive coating; and adhering said insulation tape to said wire wherein said tape covers both of said curvilinear ends and one of said planar sides of said conductor wire, the other of said planar sides of said conductor wire being substantially uncovered.

12. The method of claim 11 comprising the further step of winding said insulated magnet wire into a coil.

13. The method of claim 11 wherein said wire has a cross-section defined by a pair of planar opposing sides and a pair of at least partially radiused curvilinear opposing ends, said sides being separated by a distance which is equal to or less than the radius of curvature of said curvilinear ends.

* * * * *